US006007017A

United States Patent [19]

Vorwerk

[11] Patent Number: 6,007,017

[45] Date of Patent: Dec. 28, 1999

[54] METHOD FOR DETECTING THE POSITION OF A WEB SUPPLY ROLL AND FOR POSITIONING THE ROLL

[75] Inventor: Franz Josef Vorwerk, Margetshöchheim, Germany

[73] Assignee: Koenig & Bauer-Albert Aktiengesellschaft, Wurzburg, Germany

[21] Appl. No.: 08/993,153

[22] Filed: Dec. 18, 1997

[30] Foreign Application Priority Data

Dec. 21, 1996 [DE] Germany ..... 196 53 802

[51] Int. Cl.[6] ..... B65H 26/00; B65H 19/00

[52] U.S. Cl. ..... 242/563; 242/559

[58] Field of Search ..... 242/563, 563.1, 242/534, 534.1, 559; 414/911

[56] References Cited

U.S. PATENT DOCUMENTS

| | | | |
|---|---|---|---|
| 4,131,206 | 12/1978 | Kawada et al. | 242/563 |
| 4,586,673 | 5/1986 | Tokuno et al. | 242/559.3 |
| 4,773,609 | 9/1988 | Steffen . | |
| 4,919,353 | 4/1990 | Isowa . | |

FOREIGN PATENT DOCUMENTS

| | | |
|---|---|---|
| 227 887 | 8/1986 | European Pat. Off. . |
| 391061 | 2/1990 | European Pat. Off. . |
| 3731488 | 3/1988 | Germany . |
| 3829931 | 3/1989 | Germany . |
| 4334582 | 4/1995 | Germany . |
| 4-341444 | 11/1992 | Japan . |
| WO89/08598 | 9/1989 | WIPO . |

*Primary Examiner*—John Q. Nguyen
*Attorney, Agent, or Firm*—Jones, Tullar & Cooper, P.C.

[57] ABSTRACT

In a method for detecting the position of a web supply roll, the actual lateral positions of the two lateral faces of the web roll are detected and are compared with reference values. The differences between the actual and the reference values are used to shift the web supply roll laterally until the actual values are the same as the reference values.

4 Claims, 3 Drawing Sheets

METHOD FOR DETECTING THE POSITION OF A WEB SUPPLY ROLL AND FOR POSITIONING THE ROLL

FIELD OF THE INVENTION

The present invention is directed generally to a method for detecting the position of a web supply roll and for positioning the roll. More particularly, the present invention is directed to a method for detecting the position of a paper web supply roll in a web fed rotary printing press. Most specifically, the present invention is directed to a method for detecting the lateral position of a paper web supply roll in a roll changer of a web fed rotary printing press. The position of the roll is sensed by scanning element sensors which provide information to a control that, in turn, effects the movement of a conveying cart which shifts the web supply roll. The conveying cart that delivers the fresh supply web can also then remove the exhausted web.

DESCRIPTION OF THE PRIOR APT

It is generally well known in the field of web-fed rotary printing, to utilize large paper web supply rolls. Typically, two or three paper web supply rolls will be supported by a roll stand with one roll being unwound and with the other roll or rolls being provided as replacements for the active web roll. As the active roll becomes exhausted, the supply is switched over to the awaiting new roll in a web splice which is typically accomplished on the fly. In these prior art devices, it is generally also known to utilize scanning elements which are employed to check the presence or position of the paper web supply rolls. It is desirable to be able to automatically change the paper web supply rolls as the paper web exhausts from the first web supply roll and to switch the web supply to the full supply roll.

In the published PCT application WO 89/08598 there is depicted a roll changer in which a web supply roll is positioned between two support arms in a roll changer. Two sensors and a conveying car are utilized.

The Japanese patent publication JP-A-04-341444 shows a positioning device with a roll changer. This positioning device utilizes distance sensors which are situated in lateral frames of the device.

The prior art devices do not provide a method for detecting the lateral position of the web roll and for automatically changing this lateral position in a manner which will determine the actual roll position and will compare this actual position with a reference position so that changes in the web roll's actual position can be made. The method for detecting the position of a web supply roll and for the positioning of the web supply roll overcome the limitations of the prior art and are a significant improvement over the prior art.

SUMMARY OF THE INVENTION

It is an object of the present invention to provide a method for detecting the position of a web supply roll and for positioning the roll.

Another object of the present invention is to provide a method for detecting the position of a paper web supply roll in a web-fed rotary printing press.

A further object of the present invention is to provide a method for detecting the lateral position of a paper web supply roll and for positioning the web supply roll in a roll changer of a web-fed rotary printing press.

As will be discussed in detail in the description of the preferred embodiment which is presented subsequently, the method for detecting the lateral position of a paper web supply roll includes the placement of the paper web supply roll on a conveying cart which can be shifted both transversely and in the direction of web travel. The web supply roll is moved onto the cart into a position between two spaced sensors that each measure a lateral distance between a side face of the web supply roll and the associated sensor. This actual, measured distance is compared with reference values for each size web. These reference values have been stored in a suitable evaluating device, such as a stored program control device. The actual lateral distance values are compared with the reference values for the roll width and the roll spacing distances. If there is a deviation of the actual values from the reference values, the paper web supply roll can be shifted laterally by operation of the displaceable conveying cart.

A primary advantage of the present invention is its ability to continuously measure the distance of the paper web supply roll from a fixed position. This allows an exact lateral positioning of the web supply roll to be accomplished. The present invention also makes it possible to position web supply rolls of different widths and to also position the web rolls off-centered in a preselected position, if desired.

The method for detecting the position of a web supply roll and for positioning the roll in accordance with the present invention overcomes the limitations of the prior art. It is a substantial advance in the art.

BRIEF DESCRIPTION OF THE DRAWINGS

While the novel features of the method for detecting the position of a web supply roll and for positioning the roll in accordance with the present invention are set forth with particularity in the appended claims, a full and complete understanding of the invention may be had by referring to the detailed description of the preferred embodiment which is presented subsequently, and as illustrated in the accompanying drawings, in which:

DETAILED DESCRIPTION OF THE PREFERRED EMBODIMENT

Figure 1:
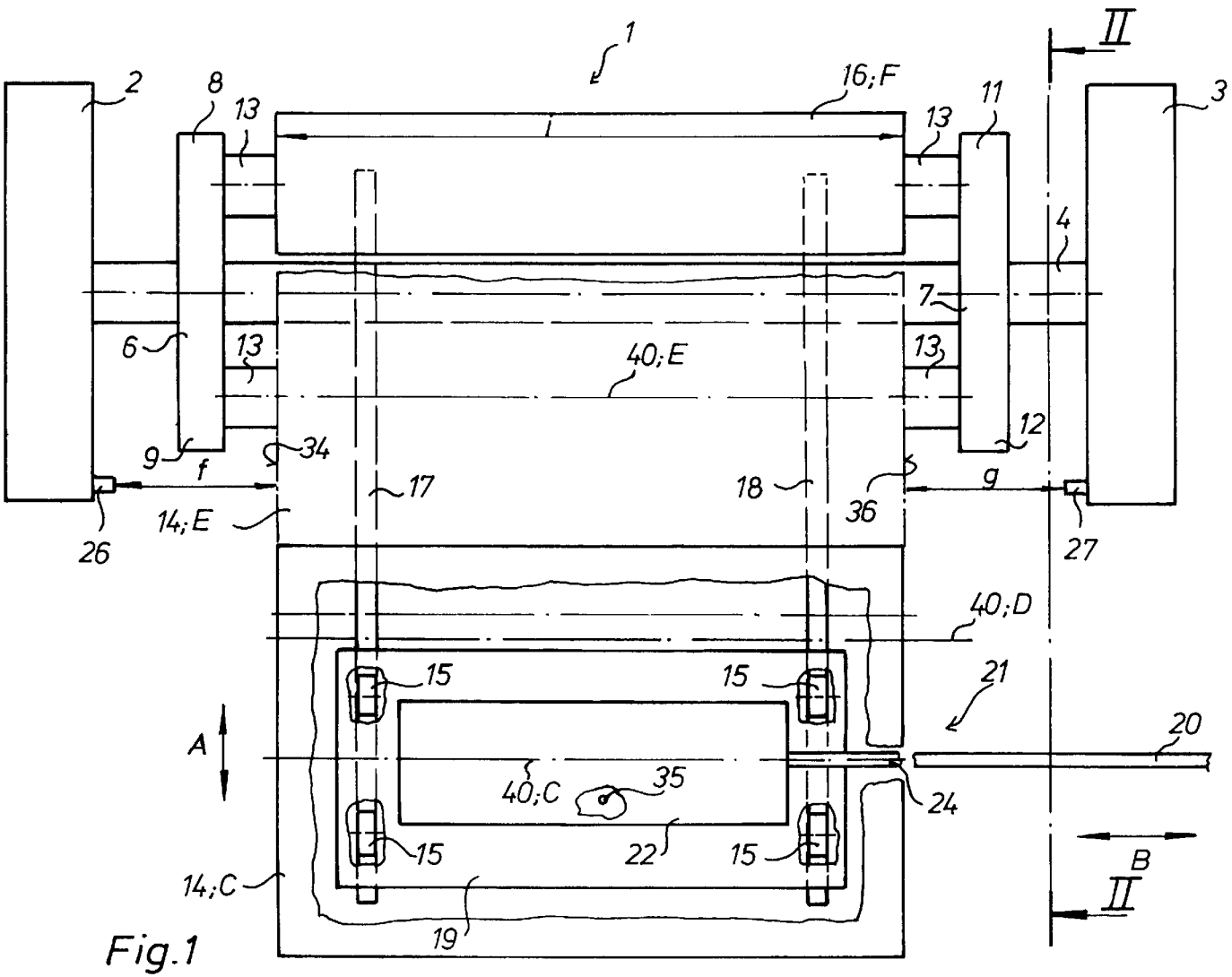
FIG. 1 is a schematic top plan view of an arrangement for the lateral position detection and positioning of a web supply roll in accordance with the present invention.
Figure 2:
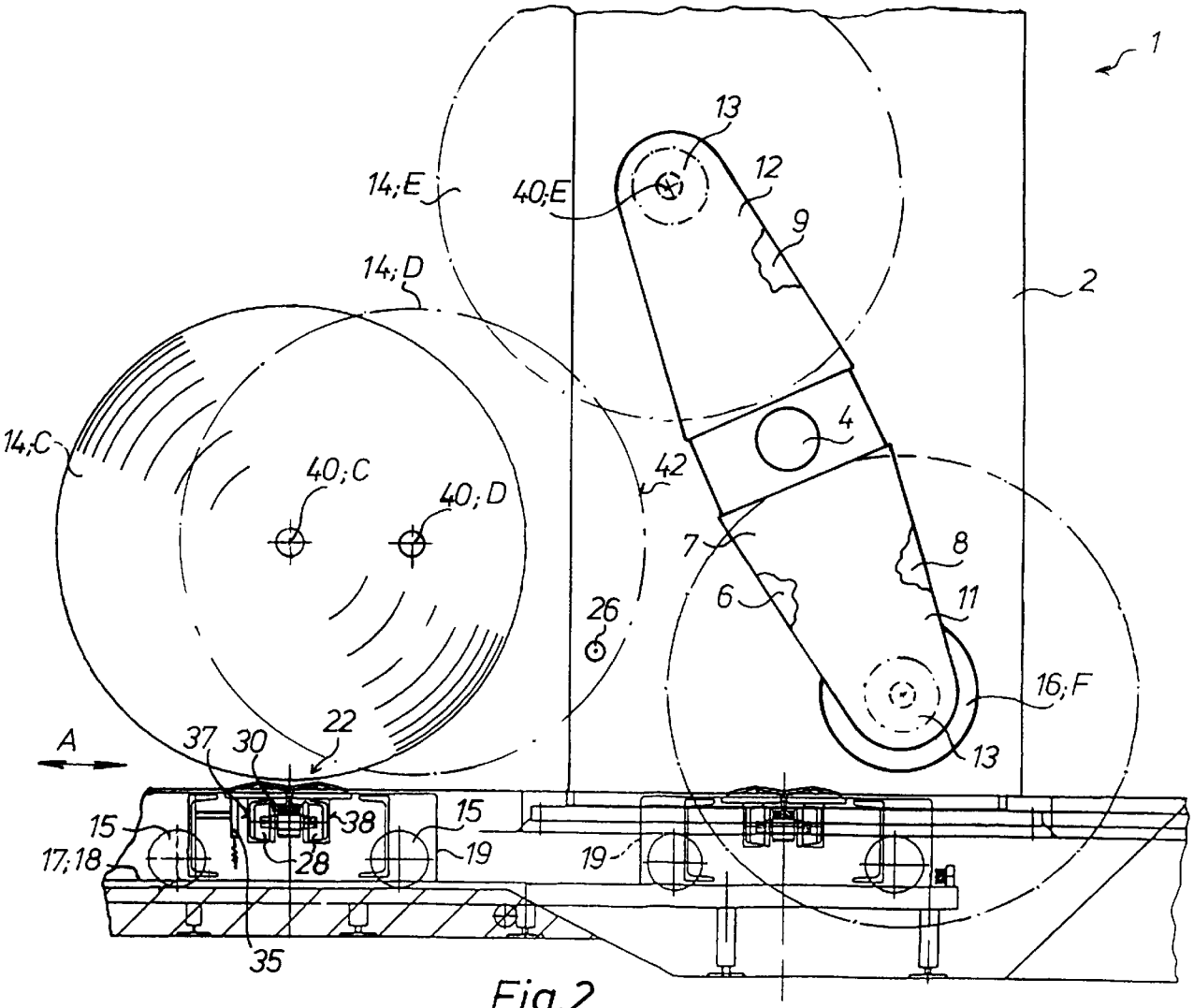
FIG. 2 is a cross-sectioza1 view of the apparatus of FIG. 1 and taken along line II—II of FIG. 1.

Referring initially primarily to FIG. 1, there may be seen an apparatus for detecting the position of a web supply roll, and for positioning the supply roll in a web-fed rotary printing press in accordance with the present invention. A roll changer 1, for use in conjunction with a web-fed rotary printing press, includes two spaced lateral frames 2 and 3, between which a drivable shaft 4 is seated. Support arms 6 and 7, which can be adjusted axially in respect to each other, are arranged on the drivable shaft 4 The support arms 6 and 7 are respectively each designed as two-armed levers and respectively each have clamping cones 13 on their outboard ends 8 and 9, and 11 and 12, respectively for receiving web supply rolls 14 and 16, for example paper web supply rolls 14 and 16, as shown in FIGS. 1 and 2. The clamping cones 13 on at least one end 8 or 9 of the lever arm are driven to thereby rotate the supply roll 14 or 16 supported therebetween.

Figure 3:
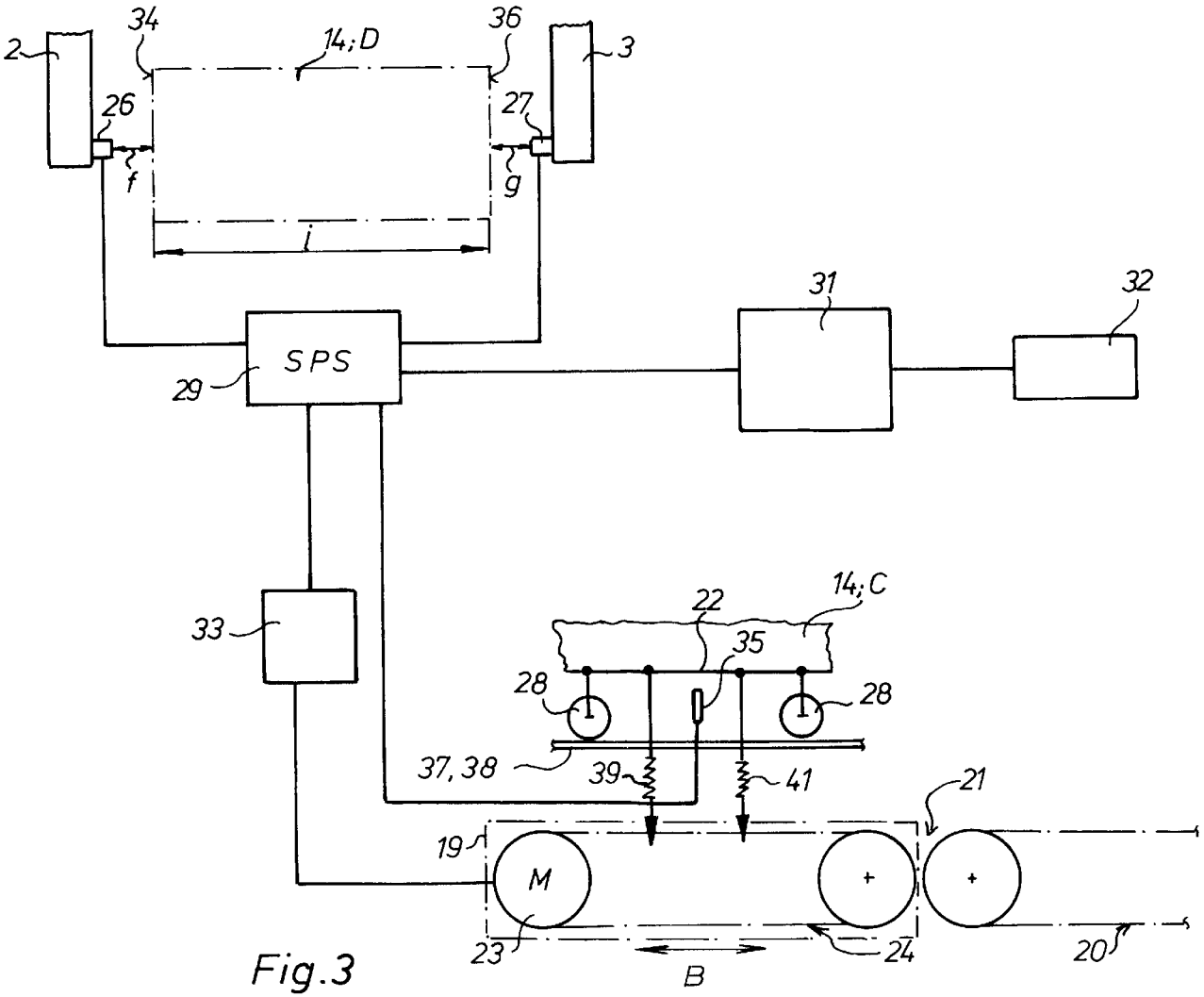
FIG. 3 is a schematic depiction of the circuit diagram for the arrangement for web supply roll detection and positioning in accordance with FIGS. 1 and 2.

A transport unit 19 for each supply roll is provided for movement, for example by means of drivable wheels 15, on rails 17 and 18. Transport unit 19 can be moved in the direction A of web travel, which web travel direction A is parallel with the lateral frames, between the lateral frames 2 and 3 of the roll changer 1 and back. The transport unit 19 is located in front of the roll changer 1 as seen in FIGS. 1 and 2. This transport unit 19 is embodied in such a way that, for example, it will receive a conveying cart 22 which is shifted by a conveyer system 21 that is located below the floor and that is movable in a lateral direction B which is parallel with the drivable shaft 4. The conveyor system 21 can consist of different, respectively separately driven, endless roller chain systems 20 and 24, which are symbolically represented in FIGS. 1 and 3 and are not shown in FIG. 2. The roller chain system 24 is located on the transport unit 19. In this case, the conveying cart 22 can be respectively moved back and forth in the transverse direction B by the use of wheels 28 which run in C-profile-like guides 31 and 38. The conveying cart 22 and the web supply roll 14 supported in cart 22, as well as an axis of rotation 40 of the web supply roll 14, are initially in the position C, on the transport unit 19, but are also in engagement with the roller chain system 24 by means of spring-loaded movers 39 and 41 which are depicted in FIG. 3. These spring-loaded movers 39 and 41 extend down from the conveying cart 22 and are engageable with the roller chain drive 24 to shift the conveying cart 22 in the transverse direction B with respect to the transport unit 19. Suitable means are provided on the conveying cart for use is in extending and retracting the spring-loaded movers 39 and 41.

Scanning elements, in the form of sensors, such as, for example laser beam or ultrasonic sensors 26 and 27, are located directly or approximately directly opposite each other at the ends of the side frames 2 and 3, as may be seen in FIG. 1. The ultrasonic sensors 26 and 27 are connected with a stored-program control unit 29 by means of electrical lines as depicted in FIG. 3. The stored-program control unit 29 is connected with a machine control station 31 and with an input 32, as well as with a drive controller 33 for a motor 23 of the roller chain system 24, all as seen in FIG. 3

An initiator 35 is fastened on the transport unit 19 and reports when the machine center, or another preselectable portion of the conveying cart 22 has reached a specific position on the transport unit 19. This initiator 35 is also connected with the stored-program control 29.

The operation of the arrangement in accomplishing the detection and positioning of a web supply roll in accordance with the present invention will now be described. A conveying cart 22 with a web supply roll 14 placed thereon, with its axis of rotation 40 oriented in the direction B transverse to the web running direction A, is conveyed on the conveyor system 21, not represented in FIG. 2, onto the transport unit 19 and into the position C shown in FIG. 2. In the process, the conveying cart 22 is placed approximately centered on the transport unit 19, which placement is detected by the sensor or initiator 35. The transport unit 19 is then moved in the direction A toward the roll changer 1, until the circumference 42 of the web supply roll 14 comes into the sensing field of the ultrasonic sensors 26 and 27, which is the dash-dotted position D depicted in FIG. 2. In FIG. 1 only the axis of rotation 40 of the web supply roller 14 is shown in position D. This movement of cart 22 can also be executed by means of a conveying system, for example by a linear drive, not represented, such as a threaded spindle. Left and right distances "f" and "g" of the lateral faces 34 and 36 of the web supply roll 14 with respect to the sensors 26 and 27 facing them, are measured in the dash-dotted position D. These measured values "f" and "g" are compared with reference values previously entered into the stored-program control 29, also taking into consideration pre-entered tolerance values In the process, it is also possible to determine the width "i" of the web supply roll 14 by subtracting the sensed distances "f" and "g" from the known spacing distance between the lateral frames 2 and 3.

If, for example, a width "i" of the web supply roll 14 is detected and is determined to lie outside of the pre-set tolerance range, an error signal, for exile a warning signal, is issued. In case of such a warning signal being generated, the roll changer 1 can be manually operated to remove the improperly sized web supply roll 14. If the width "i" of the web supply roll 14, for example, matches the preselected reference values, the actual lateral positions "f" and "g" of the web supply roll 14 are then detected. It is possible that the lateral reference distances, "f" and "g", of the web supply roll 14 may be different from each other. It is also possible, for example, to position a web supply roll 14 off-centered, such that the two reference values "f" and "g" of the left and right distance of the web supply roll 14 from the sensors 26 and 27 preferably differ from each other by the width of a multiple of a quarter-wide web supply roll 14. In other words, the amount of a difference between reference values for the left and right distances "f" and "g" is greater than or equal to the width of a quarter roll. It is therefore possible to selectively preset a machine-specific references value for the left and right lateral distances "f" and "g", and to adapt the second subordinated reference value to the width of the web supply roll 14. This is the case, for example, if it is intended to use a web supply roll 14 of half or one quarter of the width of a so-called full width web supply roll 14.

Once the actual left and right spacing distances "f" and "g" of the left and right lateral faces 34 and 36 of the web supply roll 14 from the left and right lateral frames 2 and 3 have been measured by the sensors 26 and 28, and have been compared with the pro-set reference values in the stored program control 29, the motor 23 of the conveying system 24 will be actuated by the stored-program control 29 through the drive controller, 33. The conveying cart 22 is thereby moved in the required lateral or transverse direction B until the actual values "f" and "g", measured by the ultrasonic sensors 26 and 27, agree with the reference values. The measurements of the distances "f", and "g", by means of the ultrasonic sensors 26 and 27, takes place in turns in order to prevent an interaction between them, and is so fast that this measurement can be called a continuous measurement. This process is also controlled by the stored-program control 29.

As soon as the distances "f" and "g" to the lateral faces 34 and 36 are accurate, the conveying cart 22 is fixed in place on the transport unit 19, for example by means of spring-actuated clamping elements, not specifically shown, which ire opened during positioning by means of work cylinders. Subsequently, the transport unit 19 is further displaced in the paper web running direction A toward the roll changer 1 until the web supply roll 14 reaches a receiving position, in which position it is placed on the drivable shaft 4 by means of the clamping cones 13 at the ends 9 and 12 of the support arms 6 and 7 and is brought into the dash-dotted upper position E, as seen in FIG. 2.

By further displacement of the transport unit 19 in the direction A, toward the roll changer 1, and as depicted in FIG. 2, a nearly used-up web supply roll 16; i.e. a roll containing a remainder and which has been placed in position F, can subsequently be placed an the conveying care 22. This depleted roll 16 can be moved in the direction A away from the roll changer 1 and toward the conveyor system 21 and can be transported on the conveying cart 22 by means of the conveyor system 21 in the direction B, which is parallel with the shaft 4, to a paper reservoir or storage area where the remainder of the paper web can be reclaimed.

If web supply rolls of smaller diameter are to be picked up by is a conveying cart 22, it is possible to place supports, not specifically represented, on the conveying cart 22. It is also possible to make the conveying cart 22 height-adjustable to accommodate web supply rolls 14 and 16 that have differing diameters.

In summary, the method for detecting the lateral position of a web supply roll and for positioning the roll, in accordance with the present invention, has the following characteristics:

each web supply roll 14 or 16 is placed between two sensors 26 and 27 located opposite each other, and lateral distances "f" and "g" between lateral faces 34 and 36 respectively of the web supply rolls 14 or 16 and the associated sensors 26 and 27 are measured;

reference values of different sizes, adapted to a roll width "i", for the left and right lateral distances "f" and "g" are pre-stored in an evaluating device 29;

actual values are compared with the entered reference values for each of the roll width "i" and the roll lateral spacing distance "f", and "g" in the evaluation unit 29;

on the determination of a deviation of an actual value of the roll lateral spacing distance "f" or "g" from the reference value, positioning of the web supply roll 14 or 16 is performed by movement of a conveying cart 22, which can be displaced transversely B with respect Co the web running direction A.

While a preferred embodiment of a method and apparatus for detecting the position of a web supply roll and for positioning the roll in accordance with the present invention has been set forth fully and completely hereinabove, it will be apparent to one of skill in the art that a number of changes in, for example, the drive for the printing press, the overall size of the web roll, the type of printing being accomplished and the like could be made without departing from the true spirit and scope of the present invention which is accordingly to be limited only by the following claims.

What is claimed is:

1. A method for detecting the lateral position of a web supply roll and for locating the web supply roll in a roll changer including:

providing a roll changer having roll support arms;

providing first and second lateral frames spaced apart by a width greater than a width of a full width web supply roll;

supporting said roll changer on and between said first and second lateral frames;

providing first and second sensors on said first and second lateral frames, respectively, of said roll changer;

providing a conveying cart capable of movement in a first direction toward and away from said roll changer and in a second direction transversely to said first direction and to said first and second lateral frames;

placing a partial width web supply roll on said conveying cart off-centered with respect to said first and second lateral frames;

moving said conveying cart and said off-centered partial width web supply roll supported on said conveying cart to said roll changer and positioning said conveying cart and said partial width web supply roll between said first and second sensors on said first and second lateral frames respectively of said roll changer;

measuring a first actual lateral distance from said first sensor to a first lateral face of the partial width web supply roll;

measuring a second actual lateral distance, different from said first actual lateral distance, from said second sensor to a second lateral face of the partial width web supply roll;

providing an evaluation unit;

providing first and second reference values of first and second different lateral reference distances from first and second lateral faces, respectively of a reference partial width web supply roll; storing said first and second reference values, as functions of reference partial web supply roll widths, in said evaluation unit;

supplying said measured first and second actual lateral distances to said evaluation unit;

comparing said measured first and second actual lateral distances with said first and second reference values of said first and second lateral distances in said evaluation unit;

using said evaluation unit to determine any deviations between said measured first and second actual values and said first and second reference values;

moving said conveying cart laterally along said second direction in response to said deviations between said measured first and second actual lateral distances and said first and second reference lateral distances and eliminating any said deviations; and positioning the partial width web supply roll in said roll changer off-centered laterally between said first and second lateral frames after eliminating said deviations.

2. The method of claim 1 further including supporting said conveying cart for said lateral movement on a transport unit and fixing said conveying cart in place on said transport unit upon eliminating said deviation.

3. The method of claim 2 further including moving said transport unit and said conveying cart supporting said web supply roll toward said roll changer after eliminating said deviation.

4. The method of claim 1 further including providing said first and second reference values with a difference between said first and second different lateral distances being at least equal to a width of a quarter partial width web supply roll.

* * * * *